US012385639B2

(12) United States Patent
Siddiqi

(10) Patent No.: US 12,385,639 B2
(45) Date of Patent: Aug. 12, 2025

(54) CIGAR LIGHTER WITH ENCLOSED BURN AREA

(71) Applicant: 2731848 Ontario Inc., London (CA)

(72) Inventor: Fawaz Siddiqi, London (CA)

(73) Assignee: 2731848 Ontario Inc., London (CA)

( * ) Notice: Subject to any disclaimer, the term of this patent is extended or adjusted under 35 U.S.C. 154(b) by 481 days.

(21) Appl. No.: 17/859,788

(22) Filed: Jul. 7, 2022

(65) Prior Publication Data

US 2024/0011633 A1 Jan. 11, 2024

(51) Int. Cl.

| | |
|---|---|
| ***F23Q 2/16*** | (2006.01) |
| ***F23Q 2/28*** | (2006.01) |
| ***F23Q 2/42*** | (2006.01) |

(52) U.S. Cl.

CPC ..... *F23Q 2/165* (2013.01); *F23Q 2/28* (2013.01); *F23Q 2/42* (2013.01)

(58) Field of Classification Search

CPC ... F23Q 2/165; F23Q 2/28; F23Q 2/42; F23Q 2/287; F23Q 2/44

USPC ..... 431/267

See application file for complete search history.

(56) References Cited

U.S. PATENT DOCUMENTS

| | | | | |
|---|---|---|---|---|
| 4,720,259 | A * | 1/1988 | Day | F23D 14/38 431/255 |
| 4,749,351 | A * | 6/1988 | Mahoney | F23Q 2/50 431/143 |
| 6,558,156 | B2 | 5/2003 | Wong | |
| 7,214,055 | B2 | 5/2007 | Meister et al. | |
| 7,815,432 | B2 | 10/2010 | Smith | |
| 2008/0044784 | A1* | 2/2008 | Park | F23Q 2/16 431/344 |
| 2017/0219205 | A1* | 8/2017 | Eiseman | F23D 14/58 |
| 2018/0084945 | A1* | 3/2018 | Aoyama | A47J 37/0713 |

FOREIGN PATENT DOCUMENTS

CN 103206729 A * 7/2013

* cited by examiner

*Primary Examiner* — Allen R. B. Schult
*Assistant Examiner* — William C Weinert
(74) *Attorney, Agent, or Firm* — Erise IP, P.A.

(57) ABSTRACT

A lighter for lighting cigars, cigarettes, pipes, and other objects is disclosed. The lighter may comprise an enclosed top section defining an opening for receiving the object for lighting. An inner surface of the top section includes a plurality of spouts disposed and configured to direct a plurality of flames towards a center of the opening. A bottom section may comprise a fuel reservoir, an igniter, and an actuator. The actuation may actuate the igniter which, in turn, ignites fuel from the fuel reservoir. The igniter may be a piezoelectric igniter. The enclosed burn area of the lighter with flames directed towards a center thereof may promote even burning of the object, such as a cigar.

20 Claims, 5 Drawing Sheets

CIGAR LIGHTER WITH ENCLOSED BURN AREA

TECHNICAL FIELD

Embodiments of the invention generally relate to igniting devices. More specifically, embodiments of the invention relate to a cigar lighter to promote even burning and toasting.

RELATED ART

Premium handmade cigars are a class of tobacco products which are distinguishable from cigarettes, cigarillos, and machine-made cigars. These premium cigars are consumed largely for their taste and are "sipped" but not inhaled by the consumer. Factors such as humidification, blend type, head cutting, and lighting all influence taste perception of a cigar.

Ensuring an even burn when lighting a cigar is essential to preserving the quality of the cigar. Aggressive lighting of a cigar can lead to off-putting tasting notes and can affect even the highest-quality cigars. Additionally, poor lighting can also lead to an uneven burn of the cigar. As such, cigar smokers spend considerable amounts of time learning to correctly light a cigar.

Traditional cigar lighters include butane lighters that direct a jet of flame directly upwards. Lighting a cigar using traditional cigar lighters involves "toasting" the cigar at a foot of the cigar to avoid introducing harsh and/or burnt flavors. This toasting technique requires the user to gently rotate the cigar at an angle away from the flame. Because the cigar must be manually rotated to toast the entire circumference, human error often leads to an uneven toasting of the cigar.

As such, what is needed is an improved cigar lighter. Further, what is needed is a cigar lighter that can evenly light the cigar without requiring substantial rotation of the cigar by the user.

SUMMARY

Embodiments of the invention address the above-identified need by providing a lighter for lighting cigars and other objects. The lighter may comprise a circular opening through which a cigar or other object may be passed through. Flames may be directed towards a center of the opening such that a substantially even light may be achieved by holding the object near the center of the opening.

In some aspects, the techniques described herein relate to a lighter, including: a top section having an opening therethrough, including: an outer wall; an inner wall wherein the opening is formed by the inner wall; and a plurality of spouts disposed around the inner wall, each spout of the plurality of spouts directed towards a center of the opening; and a bottom section, including: a housing; a fuel reservoir at least partially contained within the housing for storing fuel; and a passage connecting the bottom section to the top section, wherein the fuel is configured to travel through the passage to the top section, and wherein after exiting the passage, the fuel is configured to ignite to obtain a flame directed out of the plurality of spouts.

In some aspects, the techniques described herein relate to a lighter, wherein the plurality of spouts is disposed equidistantly along the inner wall.

In some aspects, the techniques described herein relate to a lighter, wherein the bottom section further includes: an igniter for igniting the fuel; and an actuator for actuating the igniter.

In some aspects, the techniques described herein relate to a lighter, wherein the igniter is a piezoelectric igniter or a flint-and-wheel igniter.

In some aspects, the techniques described herein relate to a lighter, wherein the top section further includes: a first side wall and a second side wall extending from the outer wall, wherein the first side wall is disposed opposite the second side wall.

In some aspects, the techniques described herein relate to a lighter, wherein an inner diameter of one of the first side wall or the second side wall defines a diameter of the opening, and wherein the inner diameter of at least one of the first side wall or the second side wall is adjustable.

In some aspects, the techniques described herein relate to a lighter, wherein the fuel reservoir includes a transparent or semi-transparent material.

In some aspects, the techniques described herein relate to a lighter, including: a bottom section, including: a fuel reservoir for storing fuel; an igniter for igniting the fuel to obtain a flame; and an actuator for actuating the igniter; and an enclosed top section defining an opening therethrough and coupled to the bottom section, including: a plurality of spouts disposed along an inner wall of the enclosed top section, wherein each spout of the plurality of spouts is configured to direct the flame towards a center of the opening.

In some aspects, the techniques described herein relate to a lighter, wherein the enclosed top section is circular, elliptical, or semi-circular.

In some aspects, the techniques described herein relate to a lighter, wherein the enclosed top section includes about a 60 gage diameter.

In some aspects, the techniques described herein relate to a lighter, wherein the bottom section further includes an adjustment valve for adjusting an intensity of the flame.

In some aspects, the techniques described herein relate to a lighter, wherein the adjustment valve is fluidly connected to the fuel reservoir, and wherein the adjustment valve includes a removable portion for adding additional fuel to the fuel reservoir.

In some aspects, the techniques described herein relate to a lighter, wherein the bottom section further includes a housing at least partially containing the fuel reservoir, the igniter, and the actuator.

In some aspects, the techniques described herein relate to a lighter, including: a bottom section, including: a fuel reservoir for holding fuel; an igniter for igniting the fuel; and an actuator for actuating the igniter; a top section, including: an outer wall; an inner wall including at least one spout, wherein the inner wall and the outer wall define a cavity; and a passage connecting the bottom section to the top section for providing fuel from the fuel reservoir to the at least one spout, whereby the fuel is ignited by the igniter to obtain a flame, wherein the flame exits through the at least one spout.

In some aspects, the techniques described herein relate to a lighter, further including a removable cap fluidly connected to the fuel reservoir for refilling of the fuel reservoir.

In some aspects, the techniques described herein relate to a lighter, wherein the inner wall defines an opening, and wherein the at least one spout includes a plurality of spouts directed towards a center of the opening.

In some aspects, the techniques described herein relate to a lighter, wherein the top section further includes a first side wall and a second side wall opposite the first side wall, wherein the first side wall and the second side wall extend from the outer wall, wherein at least one of the first side wall and the second side wall is adjustable to adjust a size of the opening.

In some aspects, the techniques described herein relate to a lighter, wherein the fuel reservoir is configured to be removable from the bottom section.

In some aspects, the techniques described herein relate to a lighter, wherein the bottom section is substantially rectangular and configured to be hand-held.

In some aspects, the techniques described herein relate to a lighter, wherein the top section is shaped as a partial circle defining a semi-enclosed opening, and wherein the at least one spout is directed towards a center of the semi-enclosed opening.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1A:
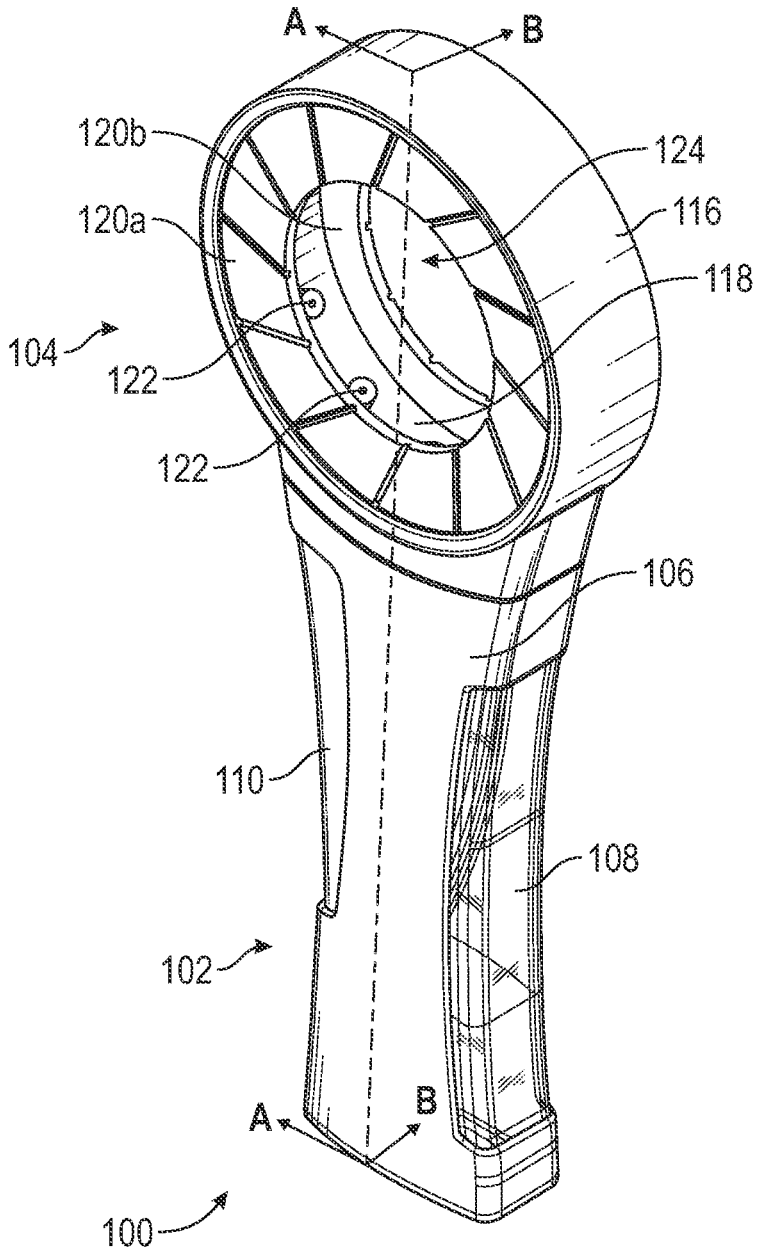
FIG. 1A illustrates a perspective view of a lighter for some embodiments.

The drawing figures do not limit the invention to the specific embodiments disclosed and described herein. The drawings are not necessarily to scale, emphasis instead being placed upon clearly illustrating the principles of the invention.

DETAILED DESCRIPTION

The subject matter of the invention is described in detail below to meet statutory requirements; however, the description itself is not intended to limit the scope of claims. Rather, the claimed subject matter might be embodied in other ways to include different steps or combinations of steps similar to the ones described in this document, in conjunction with other present or future technologies. Minor variations from the description below will be understood by one skilled in the art and are intended to be captured within the scope of the claimed invention. Terms should not be interpreted as implying any particular ordering of various steps described unless the order of individual steps is explicitly described.

The following detailed description of embodiments of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of embodiments of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate reference to "one embodiment" "an embodiment", or "embodiments" in this description do not necessarily refer to the same embodiment and are also not mutually exclusive unless so stated and/or except as will be readily apparent to those skilled in the art from the description. For example, a feature, structure, or act described in one embodiment may also be included in other embodiments but is not necessarily included. Thus, the technology can include a variety of combinations and/or integrations of the embodiments described herein.

Embodiments described herein are generally directed to a lighter having an enclosed or semi-enclosed burn area. The lighter may comprise a bottom section and a top section. The top section may be circular, having a central opening (i.e., the burn area) therethrough, with a plurality of spouts disposed on an inner surface and directed inwards towards a center of the opening. The plurality of spouts may be configured to evenly light a cigar inserted near the center of the burn area. By utilizing a circular ring of spouts, the cigar may not need to be rotated to achieve an even burn. In some embodiments, the cigar lighter may utilize butane for fuel and may comprise a piezo igniter for igniting the fuel to obtain a flame. Thus, the lighter described herein can improve the ease and consistency at which users can toast cigars.

FIG. 1A illustrates a perspective view of a lighter 100 for some embodiments. Lighter 100 may be used for lighting cigars, cigarettes, pipes, or any other object. Lighter 100 may comprise a bottom section 102 and a top section 104. Bottom section 102 may comprise housing 106, fuel reservoir 108, actuator 110, igniter 112 (see FIG. 1C), adjustment valve 114 (see FIG. 1C), or any combination thereof. Bottom section 102 may be substantially rectangular, cylindrical, square, or any other geometric shape. In some embodiments, bottom section 102 and top section 104 are detachable from one another. Thus, the user may customize lighter 100 to their preferences. For example, bottom section 102 may be replaced with a larger bottom section having a larger fuel reservoir 108 for storing more fuel. Bottom section 102 may be coupled to top section 104 via screws, welds, bolts, push fittings, snap fittings, or any other mechanical connection.

In use, a user may hold lighter 100 via housing 106. Housing 106 may at least partially contain fuel reservoir 108, actuator 110, and igniter 112. In some embodiments, igniter 112 is entirely contained within housing 106. Housing 106 may be fabricated from metals, such as stainless steel, titanium, brass, nickel, chromium, gold, silver, or any combination thereof. In some embodiments, housing 106 comprises plastic or polymers, such as DELRIN®, acetyl resin, polypropylene, polycarbonate (PC), polymethylmethacrylate (PMMA), polystyrene (PS), polyvinylchloride (PVC), or any combination thereof. In some embodiments, housing 106 comprises filleted and/or chamfered edges to improve the useability and comfort for the user when holding lighter 100. For example, housing 106 may comprise ridges, bumps, knurls, checkered patterns, or any combination thereof. In some embodiments, housing 106 comprises a sleeve, (e.g., a silicon sleeve) configured to enhance grip. Housing 106 may be contoured to comfortably fit in a user's hand for hand-held use.

In some embodiments, bottom section 102 is about 1 inch to about 3 inches in length. In some embodiments, bottom section 102 is about 0.5 inches to about 1.5 inches in width. In some embodiments, bottom section 102 is about 1.5 inches to about inches in height. In some embodiments, a larger bottom section 102 may be configured for tabletop use to hold a larger amount of fuel.

Figure 3:
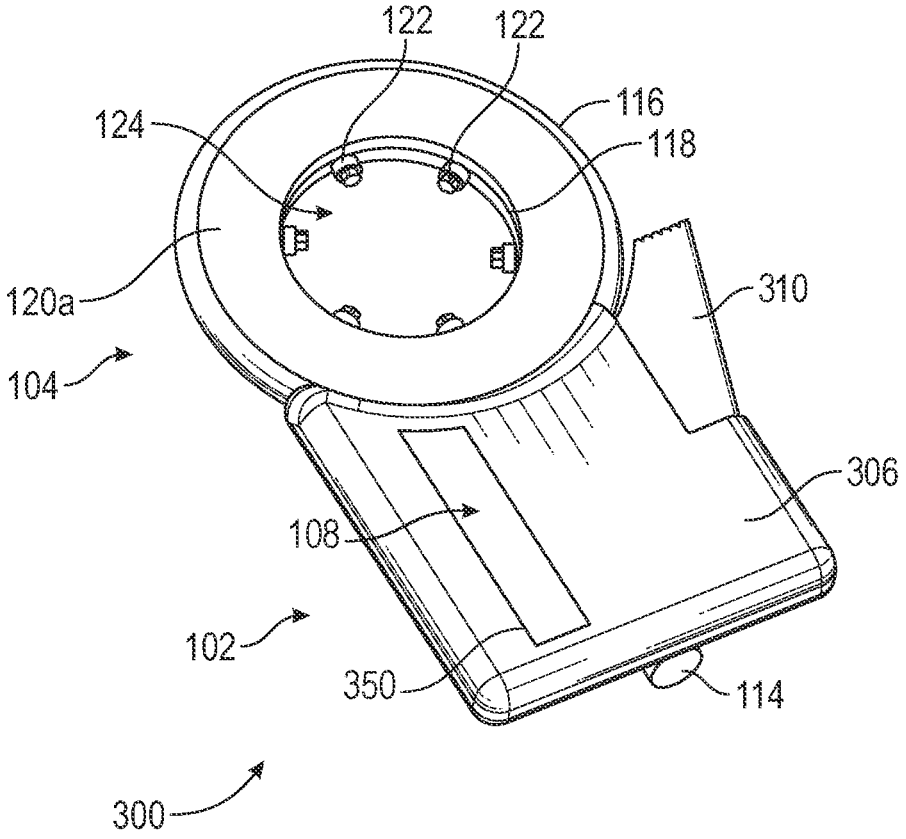
FIG. 3 illustrates a third embodiment of the lighter.

Fuel reservoir 108 may store fuel, which may be a pressurized gas in a liquid state. In some embodiments, the fuel is butane. In some embodiments, the fuel is naphtha, which may be used with a wick-based igniter 112. When the liquid fuel exits fuel reservoir 108, the fuel may undergo a state change into a gas due to the pressure differential between fuel reservoir 108 and the ambient air and mix with air, whereby the fuel may be ignited by igniter 112 to generate a flame for lighting the cigar. Fuel reservoir 108 may comprise a transparent, semi-transparent, or translucent material through which a fuel level may be monitored. For example, fuel reservoir 108 may be wholly or partially formed from borosilicate glass or poly(methyl methacrylate) (PMMA). One of skill in the art will appreciate that fuel reservoir 108 may be constructed from a variety of materials. At least a portion of fuel reservoir 108 may be exposed from housing 106 for monitoring the fuel level. For example, fuel reservoir 108 may be exposed from housing 106 on a side wall of bottom section 102. In some embodiments, housing 106 may comprise a window through which fuel reservoir 108 may be exposed, as shown in FIG. 3. In some embodiments, fuel reservoir 108 comprises markings thereon to indicate an amount of fuel left. For example, fuel reservoir 108 may comprise scale markings that indicate when fuel reservoir 108 is at 75% capacity, 50% capacity, and 25% capacity. In some embodiments, fuel reservoir 108 is substantially opaque.

Actuator 110 may be configured as a slidable actuator for actuating igniter 112 to ignite the fuel. When actuator 110 is moved from a home position in a first direction (e.g., upwards towards top section 104), igniter 112 may ignite the fuel. Simultaneously, or near simultaneously, a valve (not shown) may be opened to allow the fuel to exit fuel reservoir 108 such that the fuel may be ignited by igniter 112. When actuator 110 is moved from the first direction back to the home position, igniter 112 may be disabled and the valve may be closed. In some embodiments, actuator 110 is configured as a push button, a switch, a lever, or any other actuator mechanism. In some embodiments, actuator 110 comprises a rubber or other slip-resistant material to aid the user in actuating actuator 110. As shown, actuator 110 may be at least partially contained within housing 106 and may be exposed on a side wall of bottom section 102 substantially opposite fuel reservoir 108. Broadly, any positioning of fuel reservoir 108 and actuator 110 in bottom section 102 is considered within the scope of embodiments herein.

Top section 104 may comprise outer wall 116, inner wall 118, a first side wall 120*a* and a second side wall 120*b*, spouts 122, opening 124 or any combination thereof. Inner wall 118 may be concentric with outer wall 116. Spouts 122 may be disposed circumferentially around inner wall 118, as discussed further below. In some embodiments, outer wall 116 and/or side walls 120*a*, 120*b* comprise similar materials to housing 106. Inner wall 118 may comprise an insulated metal or ceramic. For example, inner wall 118 may comprise a ceramic material such as silicon carbide. As another example, inner wall 118 may comprise brass. Broadly, inner wall 118 may comprise any material(s) capable of withstanding the heat from the flame of lighter 100. In some embodiments, lighter 100 is configured to emit a flame in the range of about 600° F. to about 800° F. In some embodiments, lighter 100 is configured to emit flames above about 800° F. In some embodiments, the materials of lighter 100 are selected based on the desired temperature of the flame.

Side walls 120*a*, 120*b* may extend from outer wall 116 as shown. First side wall 120*a* may be disposed substantially opposite second side wall 120*b*. Side walls 120*a*, 120*b* may be formed as a ring with an inner diameter of side walls 120*a*, 120*b* defining a diameter of opening 124. In some embodiments, opening 124 comprises a 60 ring gauge diameter. In some embodiments, opening 124 comprises a diameter or width of about 3 millimeters to about 30 millimeters. While embodiments are directed towards lighting cigars, lighter 100, and opening 124 may be suitably sized to light larger sized objects as needed. In some embodiments, side walls 120*a*, 120*b* are adjustable such that opening 124 comprises a variable size. For example, the size of opening 124 may be decreased when lighter 100 is used for lighting a cigarette. For example, additional side wall portions may be hinged behind or in front of side walls 120*a*, 120*b* and deployed to decrease the effective diameter of opening 124. In some embodiments, side walls 120*a*, 120*b* are detachable from outer wall 116. Thus, in some embodiments, the user may vary the size of opening 124 by attaching smaller or larger side walls 120*a*, 120*b* to outer wall 116.

It will be appreciated that top section 104 may take any geometric shape (e.g., circular, semi-circular, rectangular, elliptical, pentagonal, etc.), and side walls 120*a*, 120*b* may match the geometry of outer wall 116 and inner wall 118. For example, if outer wall 116 is formed as a rectangle, side walls 120*a*, 120*b* may also be rectangular. In some embodiments, side walls 120*a*, 120*b* are substantially similar. In other embodiments, one of side walls 120*a*, 120*b* comprises a smaller inner diameter than the other side wall 120*a*, 120*b*. In some such embodiments, the diameter of opening 124 is defined by the side wall 120*a*, 120*b* having the smallest diameter. For example, second side wall 120*b* may comprise a smaller inner diameter (or have no opening) than first side wall 120*a* to prevent the user from overextending the cigar or object through opening 124. In some embodiments, one or both of side walls 120*a*, 120*b* is omitted from top section 104. In some embodiments, the side walls 120*a*, 120*b* may be parallel to each other. In some embodiments, one or both of the side walls 120*a*, 120*b* may be slanted towards the center of the opening.

In some embodiments, top section 104 forms a semicircle, a partial circle, or any other semi-enclosed shape. For example, outer wall 116 may comprise a three-quarter circle with an opening at the top, left, or right sides of top section 104. A semi-enclosed top section 104 may increase oxygen flow into opening 124 which may aid in evenly burning the cigar. While illustrated as a ring, top section 104 may instead take other geometric shapes such as a triangle, a rectangle, a pentagon, a hexagon, an octagon, and the like. As another example, top section 104 may comprise two opposing outer walls 116 and inner walls 118 projecting substantially upwards from bottom section 102, forming a partial rectangle. Flame may then be directed inwards from each inner wall 118 towards opening 124 for lighting of the cigar.

Figure 1B:
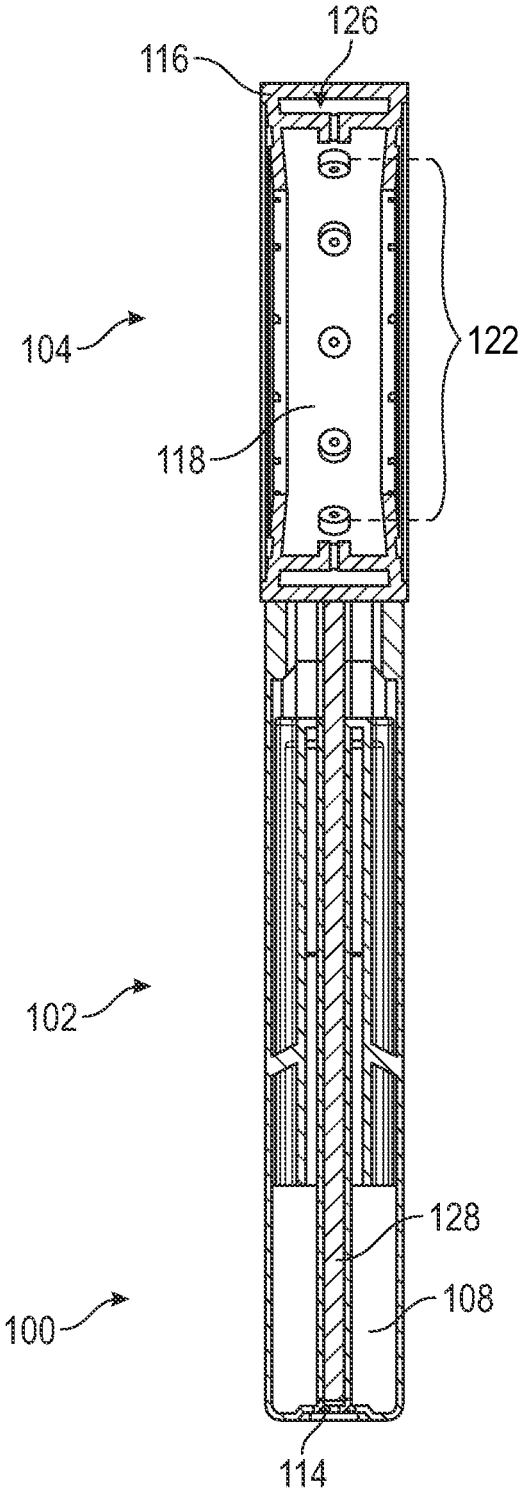
FIG. 1B illustrates a first cross-sectional view of the lighter taken along the line A-A depicted in FIG. 1A for some embodiments.

FIG. 1B illustrates a cross-sectional view of lighter 100 taken from the line A-A illustrated in FIG. 1A. As shown, top section 104 outer wall 116 and inner wall 118 may comprise a gap therebetween defining a cavity 126. Spouts 122 may be disposed on inner wall 118 and project inwards towards a center of opening 124. Fuel may flow from fuel reservoir 108 through a passage 128 and into cavity 126 before exiting (after ignition, as a flame) out of spouts 122.

In some embodiments, spouts 122 are spaced equidistantly on inner wall 118. For example, when top section 104 is configured as a circle, six spouts 122 may be spaced at 60° intervals on inner wall 118. Alternatively, four spouts 122 may be spaced at 90° intervals, or eight spouts 122 may be spaced at 45° intervals. Broadly, any arrangement of spouts 122 around the inner wall 118 is considered for embodiments herein, and spouts 122 are not limited to being equally spaced along inner wall 118. In some embodiments, the spouts 122 are spaced unevenly. Spouts 122 may be directed substantially towards a center of opening 124. As such, a user may insert a cigar near the center of opening 124 and receive a substantially even light from flame exiting each of the plurality of spouts 122 without having to rotate the cigar. Further, as described below, the user may utilize adjustment valve 114 to adjust an intensity of the flame exiting spouts 122 to increase the lighting efficiency of objects having smaller dimensions (e.g., a cigarette).

In some embodiments, spouts 122 are not directed towards the center of opening 124. For example, when top section 104 is formed as a partial rectangle, a first spout may be directed horizontally to toast a top surface of a cigar inserted into the center of opening 124, and a second spout may be directed horizontally and disposed below the first spout to toast a bottom surface of the cigar.

Spouts 122 may comprise a circular, square, triangular, or any other shape orifice through which the flame exits. Spouts may comprise a diameter or width of less than about 1 millimeter to about 1 millimeter. In some embodiments, spouts 122 comprise a diameter or width of about 1 millimeter to about 3 millimeters. In some embodiments, spouts 122 comprise similar materials to inner wall 118.

Figure 1C:
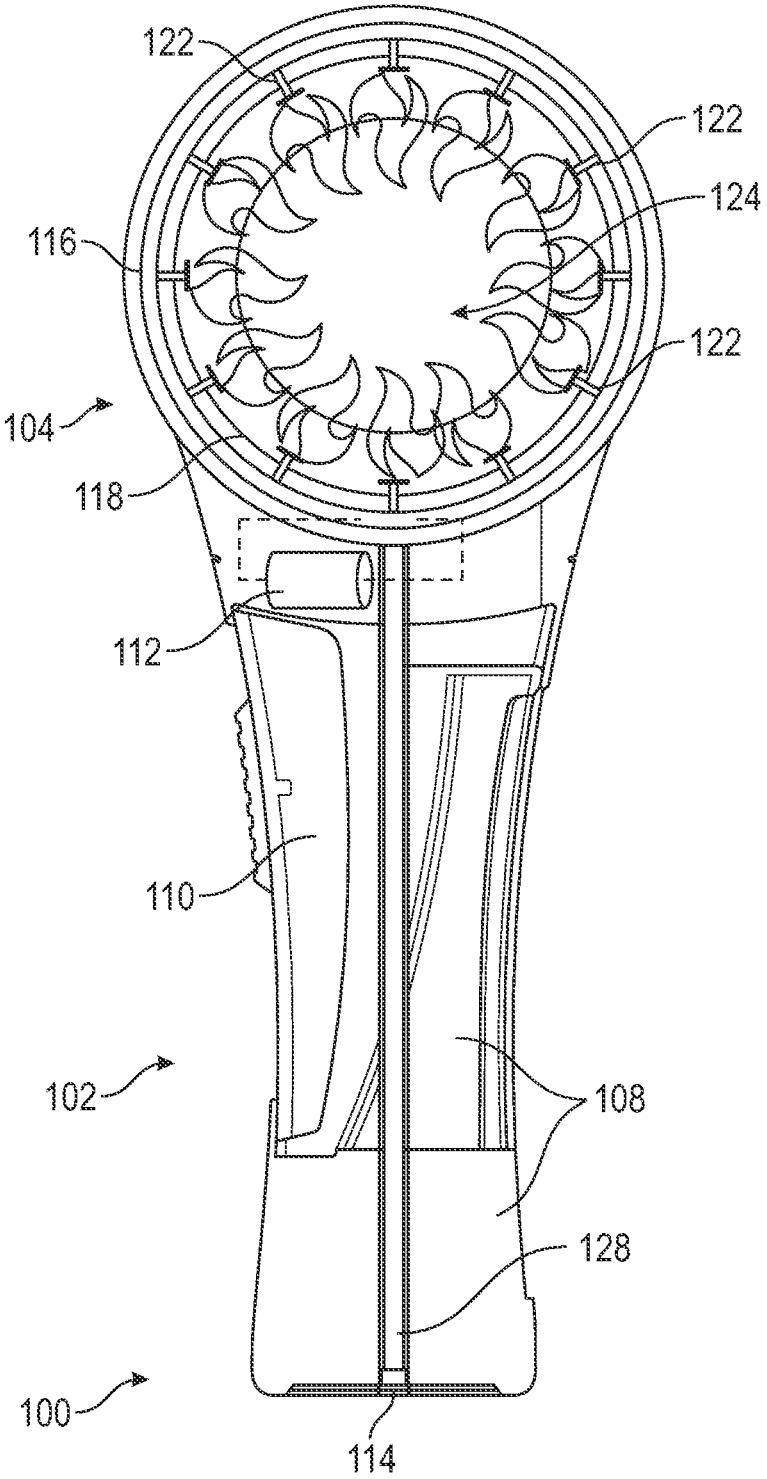
FIG. 1C illustrates a second cross-sectional view of the lighter taken along the line B-B depicted in FIG. 1A for some embodiments.

FIG. 1C illustrates a cross-sectional view of lighter 100 taken along the line B-B as depicted in FIG. 1A for some embodiments. In some embodiments, top section 104 is substantially symmetrical about line B-B.

Fuel may flow from fuel reservoir 108 through a passage 128 and into top section 104 whereby the fuel may be ignited by igniter 112. Passage 128 may have a proximal end near a bottom face of bottom section 102 and a distal end near top section 104. In some embodiments, passage 128 is formed as a plastic or metal cylindrical or rectangular tube.

As described above, lighter 100 may comprise adjustment valve 114 on a bottom face of bottom section 102. In some embodiments, adjustment valve 114 is a dual-purpose knob that may allow the user to adjust an intensity of the flame and add additional fuel to fuel reservoir 108. Rotating adjustment valve 114 in a first direction may increase the flame intensity, and rotating adjustment valve 114 in a second direction that is opposite the first direction may decrease the flame intensity. In some embodiments, rotation of adjustment valve 114 causes a valve (not shown) disposed at the distal end of passage 128 to rotate open and/or closed. As the valve is opened, the amount of fuel exiting passage 128 may increase, thereby increasing the flame intensity. Adjusting the flame intensity may aid in lighting varying sizes of cigars, cigarettes, and the like. For example, if opening 124 is sized for 60 gage diameter cigars, a 30 gage diameter cigar may be lit with a higher flame intensity such that an even burn can be achieved while keeping the cigar substantially stationary in the center of opening 124.

In some embodiments, adjustment valve 114 comprises a removable knob, cap, or the like that provides access for adding additional fuel to fuel reservoir 108. Additionally, or alternatively, in some embodiments, a cap or other access point to fuel reservoir 108 may be disposed separately from adjustment valve 114. In some embodiments, lighter 100 is non-refillable, and adjustment valve 114 is permanently secured to bottom section 102. In some such embodiments, adjustment valve 114 may be used solely to adjust the intensity of the flame. In some embodiments, fuel reservoir 108 may be removable from housing 106 such that a new fuel reservoir 108 can replace an empty reservoir.

As shown, fuel reservoir 108 may comprise a majority of a volume of bottom section 102. Fuel may escape through passage 128 and into cavity 126 due to the depressurization caused by opening of the valve near the distal end of passage 128 that results in the liquid fuel undergoing a state change to gaseous fuel for igniting by igniter 112. Passage 128 may be fluidly connected to fuel reservoir 108. Igniter 112 may be disposed near actuator 110 whereby igniter 112 may be actuated by actuator 110. In some embodiments, igniter 112 is a piezoelectric igniter comprising a hammer that, when actuated, strikes a piezoelectric crystal to generate a spark, thereby igniting the fuel exiting passage 128 and into cavity 126 to obtain a flame. The flame may then travel through cavity 126 and out of spouts 122 into opening 124 to light the cigar. Those skilled in the art will appreciate that other igniting mechanisms, such as a flint-and-wheel igniter may be used without departing from the scope hereof. In some embodiments, multiple igniters may be provided and spaced closer to the spouts 122.

Figure 2:
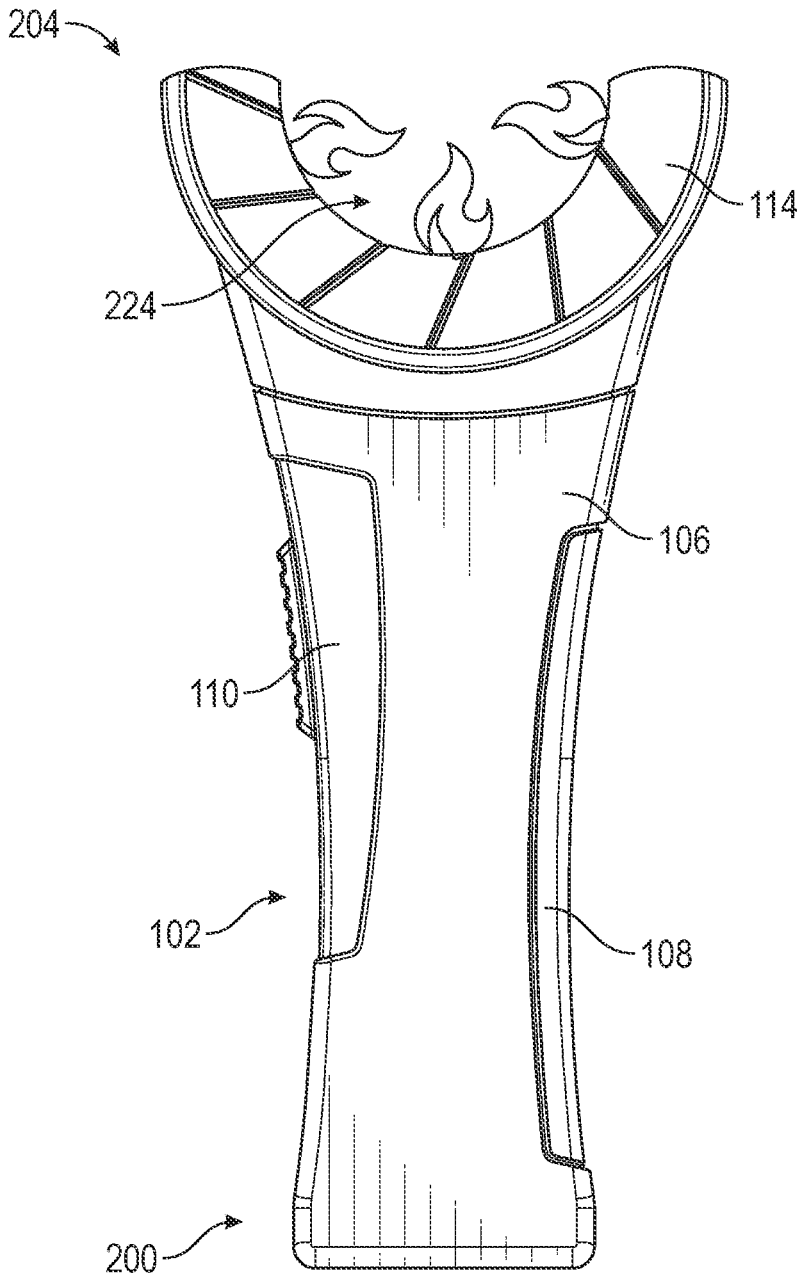
FIG. 2 illustrates a second embodiment of a lighter having a semi-enclosed burn area.

FIG. 2 illustrates an embodiment of lighter 200 having a semi-enclosed top section 204 for some embodiments. A semi-enclosed top section 204 may increase the oxygen flow through opening 224 which may aid in toasting the cigar. In some embodiments, the semi-enclosed top section 204 is a semicircle. In some embodiments, top section 204 may comprise two parallel walls defining an opening 224 therebetween, forming a partial rectangle. Other geometric shapes are contemplated as within the scope of embodiments herein. Spouts 122 may be positioned appropriately to direct the flame towards a central location of opening 224. For example, in the embodiment of the partial rectangular top section 204 described above, spouts 122 may be directed perpendicularly from the two parallel inner walls and spaced such that the user may insert a cigar into the burn area and the flame will evenly toast the circumference of the cigar.

FIG. 3 illustrates a third embodiment of lighter 300. Lighter 300 may be substantially similar to lighter 100. As shown, lighter 300 comprises a window 350 for viewing fuel reservoir 108 near a middle portion of housing 306. In some embodiments, actuator 310 is a push button actuator which may be depressed by the user to engage the igniter 112. Actuator 310 may be a push-and-hold actuator requiring the user to hold actuator 310 in the depressed position to maintain the flame. In other embodiments, upon depressing actuator 310, a second depression of actuator 310 is required to release actuator 310 from the engaged position to close off passage 128. As illustrated with respect to FIG. 3, the cross-section of bottom section 102 may take a substantially square shape.

While embodiments have been described herein with respect to utilizing lighter 100, 200, 300 for lighting cigars, it should be noted that lighter 100, 200, 300 may be used to light various objects. For example, lighter 100, 200, 300 may be used to light cigarettes, cigarillos, marshmallows, and smoking pipes. Additionally, lighter 100, 200, 300 may be used in industrial lighting environments. For example, lighter 100, 200, 300 may be used to heat and/or burn objects passing by on a conveyor belt in a manufacturing setting. It is contemplated that lighter 100, 200, 300 may be coupled with a control system that is configured to signal lighter 100, 200, 300 (e.g., wired or wirelessly) to turn on and off in response to varying conditions. The control system may also control adjustment valve 114 to adjust the intensity of the flame. As one example, lighter 100, 200, 300 may be used to toast marshmallows prior to packaging.

Further, bottom section 102 may be configured for use as a tabletop lighter. For example, bottom section 102 may be a substantially large cube or hemisphere configured to sit on a table and store enough fuel for use in commercial environments, such as at a smoking lounge.

Many different arrangements of the various components depicted, as well as components not shown, are possible without departing from the scope of the claims below. Embodiments of the invention have been described with the intent to be illustrative rather than restrictive. Alternative embodiments will become apparent to readers of this disclosure after and because of reading it. Alternative means of implementing the aforementioned can be completed without departing from the scope of the claims below. Certain features and sub-combinations are of utility and may be employed without reference to other features and sub-combinations and are contemplated within the scope of the claims. Although the invention has been described with reference to the embodiments illustrated in the attached drawing figures, it is noted that equivalents may be employed, and substitutions made herein, without departing from the scope of the invention as recited in the claims.

The invention claimed is:

1. A lighter, comprising:
a top section having an unobstructed opening therethrough, comprising:
an outer wall;
an inner wall, wherein the unobstructed opening is formed by the inner wall; and
a plurality of spouts disposed around the inner wall, each spout of the plurality of spouts directed towards a center of the unobstructed opening; and
a bottom section, comprising:
a housing, the housing at least partially containing:
a fuel reservoir for storing a fuel;
an actuator; and
an igniter; and
a passage connecting the bottom section to the top section,
wherein the fuel is configured to travel through the passage to the top section, and
wherein after exiting the passage, the fuel is configured to ignite via the igniter to obtain a flame directed out of the plurality of spouts towards the center of the unobstructed opening.

2. The lighter of claim 1, wherein the plurality of spouts is disposed equidistantly along the inner wall.

3. The lighter of claim 1, wherein the actuator is configured to actuate the igniter.

4. The lighter of claim 1,
wherein the igniter is a piezoelectric igniter or a flint-and-wheel igniter.

5. The lighter of claim 1, wherein the top section further comprises:
a first side wall and a second side wall extending from the outer wall,
wherein the first side wall is disposed opposite the second side wall.

6. The lighter of claim 5,
wherein an inner diameter of one of the first side wall or the second side wall defines a diameter of the unobstructed opening, and
wherein the inner diameter of at least one of the first side wall or the second side wall is adjustable.

7. The lighter of claim 1, wherein the fuel reservoir comprises a transparent or semi-transparent material.

8. The lighter of claim 1, wherein the top section is shaped as a partial circle.

9. A lighter, comprising:
a bottom section, comprising:
a housing, the housing at least partially containing:
a fuel reservoir for storing a fuel;
an igniter for igniting the fuel to obtain a flame; and
an actuator for actuating the igniter; and
an enclosed top section coupled to the bottom section and defining an unobstructed opening therethrough, the enclosed top section comprising:
a plurality of spouts disposed along an inner wall of the enclosed top section,
wherein each spout of the plurality of spouts is configured to direct the flame towards a center of the unobstructed opening.

10. The lighter of claim 9, wherein the enclosed top section is circular, elliptical, or semi-circular.

11. The lighter of claim 10, wherein the enclosed top section comprises about a 60 gage diameter.

12. The lighter of claim 9, wherein the bottom section further comprises an adjustment valve for adjusting an intensity of the flame.

13. The lighter of claim 12,
wherein the adjustment valve is fluidly connected to the fuel reservoir, and
wherein the adjustment valve comprises a removable portion for adding additional fuel to the fuel reservoir.

14. A lighter, comprising:
a bottom section, comprising:
a housing, the housing at least partially containing:
a fuel reservoir for holding a fuel;
an igniter for igniting the fuel; and
an actuator for actuating the igniter;
a top section having an unobstructed opening therethrough, the top section comprising:
an outer wall; and
an inner wall comprising at least one spout,
wherein the inner wall and the outer wall define a cavity; and
a passage connecting the bottom section to the top section for providing the fuel from the fuel reservoir to the at least one spout, whereby the fuel is ignited by the igniter to obtain a flame,
wherein the flame exits through the at least one spout towards a center of the unobstructed opening.

15. The lighter of claim 14, further comprising a removable cap fluidly connected to the fuel reservoir for refilling of the fuel reservoir.

16. The lighter of claim 14,
wherein the inner wall defines an opening, and
wherein the at least one spout comprises a plurality of spouts directed towards the center of the opening.

17. The lighter of claim 16,
wherein the top section further comprises a first side wall and a second side wall opposite the first side wall,
wherein the first side wall and the second side wall extend from the outer wall, wherein at least one of the first side wall and the second side wall is adjustable to adjust a size of the opening.

18. The lighter of claim 14, wherein the fuel reservoir is configured to be removable from the bottom section.

19. The lighter of claim 14, wherein the bottom section is substantially rectangular and configured to be hand-held.

20. The lighter of claim 14, wherein the top section is shaped as a partial circle.

* * * * *